US005127424A

United States Patent [19]

Stein et al.

[11] Patent Number: 5,127,424

[45] Date of Patent: Jul. 7, 1992

[54] CLEANING DEVICE FOR PRECISION CASTINGS

[75] Inventors: Lothar Stein, Saarbrucken; Rheinold Thewes, Breckerfeld, both of Fed. Rep. of Germany

[73] Assignee: Reinhold Thewes, Breckerfeld, Fed. Rep. of Germany

[21] Appl. No.: 561,610

[22] Filed: Aug. 2, 1990

[30] Foreign Application Priority Data

Aug. 8, 1989 [DE] Fed. Rep. of Germany ..... 3926174
Jun. 20, 1990 [DE] Fed. Rep. of Germany ..... 4019589

[51] Int. Cl.[5] ..... B08B 3/12

[52] U.S. Cl. ..... 134/143; 134/1; 134/147; 134/155; 134/161; 134/162; 134/186

[58] Field of Search ..... 134/1, 184, 104.4, 135, 134/143, 137, 149, 155, 157, 161, 162, 186

[56] References Cited

U.S. PATENT DOCUMENTS

| | | | |
|---|---|---|---|
| 2,987,068 | 6/1961 | Branson | 134/184 |
| 3,420,758 | 1/1969 | Scheer | 134/1 X |
| 3,520,724 | 7/1970 | Massa | 134/1 |
| 3,527,607 | 9/1970 | Antonevich | 134/1 |
| 3,557,807 | 1/1971 | Shipke | 134/1 |
| 4,120,699 | 10/1978 | Kennedy, Jr. et al. | 134/1 |
| 4,561,902 | 12/1985 | Lee | 134/1 |
| 4,582,077 | 4/1986 | Gabriel et al. | 134/184 X |
| 4,724,853 | 2/1988 | Hirose | 134/184 X |
| 4,826,538 | 5/1989 | Sanders et al. | 134/1 |

FOREIGN PATENT DOCUMENTS 1596073 8/1981 United Kingdom .

*Primary Examiner*—Philip R. Coe
*Attorney, Agent, or Firm*—James Creighton Wray

[57] ABSTRACT

With a cleaning device that uses high-voltage discharges in liquids, it is possible to safely clean even clusters of precision castings if a tubular processing chamber serves as shock wave reflector and the position of the component and of the electrode are variable. Casting elements encrusted both with thin ceramic layers and with more ductile deposits are safely cleaned after they are lowered into the tubular chamber with sealable apertures on both sides, and after shock waves have been generated via the electrode positioned in the chamber. The tubular configuration of the chamber, which is preferably positioned endwise, makes it possible in particular to utilize the reflection waves to clean the individual components. By way of a hoist, the component configured as a cluster as well as any other configured component is passed by the electrode, turned, and if necessary swivelled in order to thus ensure a uniform and rapid cleaning. The chamber itself is filled with water in order to conduct the shock waves, whereby water and residue are continually diverted in the base area while new water is added at the top, preferably the recycled and purified water.

13 Claims, 5 Drawing Sheets

CLEANING DEVICE FOR PRECISION CASTINGS

BACKGROUND OF THE INVENTION

The invention relates to a cleaning device for castings and similar components with coatings, especially for precision casting elements covered with a thin ceramic layer, with a chamber filled with water and an electrode positioned in the water, as well as the hoist that moves the components.

Various processes are used to clean castings or casting elements, some of which are tailored to the casting in question and some of which are used for all castings. For example, castings made of hard metal are cleaned by sand blasting, which is generally possible only through manual operation. Furthermore, sand blasting is possible only with hard metals, since otherwise the material being cleaned is partially worn away or else deformed. A further disadvantage is that with sand blasting only a relatively small amount of pressure can be applied in order to ensure error-free operation. Since the castings to be cleaned must be moved around in the sand blast, or the sand blasting generator must be guided around the casting element to be cleaned, the total cleaning process is very costly. There are also chemical processes in which sand and other deposits are removed chemically. Besides the current, increasingly critical problems with waste disposal, however, managing these processes is costly and demands a great deal of time, so that these processes too are used only in very limited applications. With soft metal materials such as copper and aluminum, high-pressure water is also used, whereby the water-jet systems spray water on the casting element to be cleaned at pressures of up to 500 bar. This relatively gentle treatment is advantageous, but a correspondingly high level of pressure is possible only with correspondingly hard material, so that the use of this process is also limited. In precision casting in particular, where for example several individual casting elements are cast together in a cluster using a large mold, the ceramic coating left on the casting elements or the corresponding thin layer has a very detrimental effect. Work must be undertaken with great care in order not to affect or even damage the individual casting elements. On the other hand, however, due to the hardness of the ceramic layer, it is in turn necessary to work intensively and with corresponding pressure, so that the cleaning process involves considerable problems.

For large casting elements, a high-voltage discharge in liquids is also used. One such system is described in Industrieanzeiger [Industry Gazette], No. 42, Vol. 107, 1985, pp 16 ff, as a casting cleaning device with a high-voltage discharge. With a hoist, one or more castings are lowered into a water bath until the surface is clearly below the surface of the water. An electrode submerged in the water that is agitated in the water bath specific to the component generates at intervals a highvoltage discharge over the casting elements to be cleaned, which serve at the same time as the first electrode. Because of this, shock waves are generated that use the water as the medium of transmission to remove all sand residue, so that the casting elements are metallically polished after the cleaning process. It must be noted that the casting material as well is not spared the effects of the powerful discharges of energy, since the high voltage is discharged directly at the component, whereby because of the high cost savings and the clearly reduced dust load, this established process involves significant advantages. Corresponding systems have already been used successfully in the East Bloc area in particular, as a brochure from Machino-Export USSR Moscow shows. On page 13 there, a system is depicted in which apparently several electrodes spaced at intervals from each other are positioned above the casting to be cleaned that also serves as an electrode. In order to clean both sides of this casting, it must be turned by the hoist, which requires significant additional operating time and is also very laborious. Furthermore, for three-dimensional casting elements, the success of the cleaning process is called into question, since the shock waves cannot reach all the areas of the casting element. The chamber holding the casting element and the electrodes is a rectangular or square water container that is open at the top. Furthermore, the explanations reveal that this electrohydraulic process is used only to remove the core and sandy deposits from castings. Thus far, this process has apparently not been used for precision castings, nor is it applicable, since the necessary uniform stress of the surface of the casting elements is not ensured by the shock waves. Another disadvantage of this known process is that the generated shock wave can be used only partially and to a very unsatisfactory extent, since the individual casting elements can be cleaned only one side at a time.

SUMMARY OF THE INVENTION

The problem of the invention is to create a cleaning device with which both recalcitrant and soft deposited layers, to which precision casting elements in particular are subject, can be removed safely and without damage to the casting element and in a reasonable amount of time.

According to the invention, the problem is solved by a chamber with a tubular configuration and closable apertures and an electrode that when viewed in a longitudinal direction is positioned approximately in the middle of the chamber and when viewed from the cross-section is positioned in the vicinity of the chamber wall.

The tubular processing chamber is advantageous as a shock wave reflector, in which the component to be treated and the electrode position can be varied with respect to one another in such a way that a component-specific, optimal utilization of the reflected shock waves is possible. For example, a cluster consisting of several precision casting elements can be completely cleaned in a short period of time and freed of deposits, especially the ceramic layer. These clusters are ultimately the most complicated components to be cleaned, so that the success that can be achieved with the invention must be given especially high marks. Because of the special configuration of the chamber, the reflected shock waves in particular can be used advantageously for cleaning the component, whereby the chamber on the whole advantageously serves as a reflector. The component and electrode can be positioned in such a way that a component-specific, optimal utilization of the reflected shock waves is possible. Softer materials such as copper and aluminum can also be cleaned safely, since relatively low levels of pressure are used. The chamber has closable apertures on both sides, which facilitates inserting the component as well as removing the loosened material. The cleaning process is significantly accelerated. It also becomes considerably safer. The energy applied is put to its best possible use. Since the shock waves are generated independently of the component, it can be moved freely in the chamber. The reflected shock wave that is begun outside the casting element or component reaches the component to be cleaned practically from all sides, including projections and recesses. The electrode assumes an optimal position vis-à-vis the component, so that inserting and removing the component-e.g., the cluster-is not hindered. The generation of the reflected shock waves can be supported even more by positioning disk or ring reflectors at the site of shock wave generation. Furthermore, the shock wave can be effectively influenced in intensity and direction by changing the position of the electrode and by deflecting the wave. Both recalcitrant and softer deposited layers are safely separated from the casting element in this way. The device permits easy and favorable adaptation to various components without major cost.

According to one useful configuration of the invention, the chamber is positioned endwise and has a detachably configured closure on either side. The waste material is removed through the lower closure and the components to be cleaned are pulled out from the top after the closure is opened, or inserted into the chamber from above. The water needed is subjected to a replacement cycle that is controlled externally in order to remove any potentially disruptive suspended particles, during the processing phase as well. Thus, the process can be performed with little wasted energy, and without need of major preparatory or cleaning work.

The interior walls of the closures too are used effectively to reflect the shock waves, in that the closures have an open recess that acts as a reflector and faces the interior of the chamber. In this way, the waves are cast back from this area as well in such a way that they serve advantageously as reflection waves to clean the component. An especially effective use of the reflected shock waves is ensured through an eccentric insertion of the component into the chamber (FIG. 3). According to claim 16, this is achieved by positioning the rod eccentrically in the closure, namely in the upper closure.

It is also conceivable that the entire interior of the chamber is shaped as an ellipse, whereby the component or special areas of it that are to be cleaned are positioned in the focal point of the ellipse, which is particularly advantageous when the component is extremely dirty or has an especially problematic coating.

In order to ensure perfect reflection of the shock waves in the area of the lower closure as well, the invention provides for an outlet hole in the lower closure, to which either a container is allocated that is equipped with a solid matter valve positioned at the base and with a water outlet or a reel conveyor belt is allocated that handles both continual disposal of waste and necessary water replacement. In this way, a layer of waste material cannot form on the reflection surface of the lower closure. Rather, the waste material is diverted immediately through the outlet hole into the container positioned below it or onto the conveyor belt.

The lowering and removal of the components can be advantageously accelerated if the upper closure has a hole in the bottom of the recess that holds the rod of the hoist and is equipped with a ring consisting of flexible material or a universal joint hole. In this way, the closure is lifted together with the hoist when the latter raises the component from the chamber. Accordingly, it is not necessary to first lift the closure before inserting or lowering the component into the chamber; rather, the closure is lowered into the chamber together with the component to be cleaned, and seals the chamber, so that the cleaning process can be initiated quickly. It is expedient here to replace the small amount of water diverted off with the waste material prior to cleaning.

According to the invention, the hoist is configured to lower and raise as well as to rotate and swivel the rod. The component to be cleaned can thus be moved about in the chamber in such a way that it is in the optimal position for being affected by the shock waves or reflection waves. The swivelling here is possible in that the hole has either a ring made of flexible material that easily allows an inclined position of the rod while guaranteeing the seal, or a universal joint slaving.

Because of the configuration of the hoist, it is possible to raise and lower the component to be cleaned within the chamber as well, including during the cleaning process. In this way, the component to be cleaned can be practically passed by the electrode, meaning that a rapid and complete cleaning is ensured especially by the fact that the chamber is larger or longer, preferably twice as long as the components to be cleaned or as the cluster. Such a cleaning device guarantees that the cluster or other component will be influenced from all sides, due to the reflection waves in particular. In this way, an optimal and uniform cleaning of the corresponding components can be undertaken in a surprisingly short period of time.

Another possibility for accelerating the cleaning process results from the fact that an expedient further development of the invention provides for the electrode to be positioned in the chamber so as to be positionally variable. In this way, it is possible to move either the component or the electrode in the chamber, or else both elements, in order to make optimal use of the shock or reflection waves in the cleaning process.

A particularly intensive and homogeneous configuration of shock waves and thus of reflection waves can be achieved by having the electrode configured as a copper wire with a curved and radial position in the chamber, preferably with a diameter of 0.5 mm. An electrode in this configuration results in a linear discharge of pressure, whereby the copper wire vaporizes due to its small diameter. In this way, a particularly intensive shock wave is generated. It is conceivable here that several of these electrodes could be positioned across the length of the chamber in order to thus shorten or intensify the cleaning process even more.

In order to make possible a rapid "recharge" of the electrode, the invention provides for the copper wire to be magazined outside the chamber, whereby a feeding mechanism is allocated to the wire magazine. In this way, after the copper wire is used up a new one can be quickly fed in and through the chamber, so that the electrodes needed for the next cleaning process are immediately available.

A punctiform shock wave discharge can also be achieved by having the electrode consist of a coaxial conductor. This point discharge causes an effective generation of reflection waves and thus a uniform distribution across the entire component.

The invention is especially characterized by the fact that a cleaning device has been created that makes it possible to clean even complex components in a short period of time, safely, and without damage. Because of the multiple utilization of the generated shock waves in the form of reflection waves, the cleaning process is not only shortened, but also intensified, and is moreover adjustable to such an extent that it can be used with surprising safety for precision casting elements as well, which have a deposited layer consisting of ceramic, for example. In this way, it is possible to clean not only components of unfavorable dimensions and configurations safely and quickly, but also those that have a very stubborn coating that is difficult to remove.

Further details and advantages of the subject of the invention can be found in the following description of the accompanying drawing, in which the preferred embodiments are depicted with the necessary details and individual elements. Depicted are:

DETAILED DESCRIPTION OF THE DRAWINGS

Figure 1:
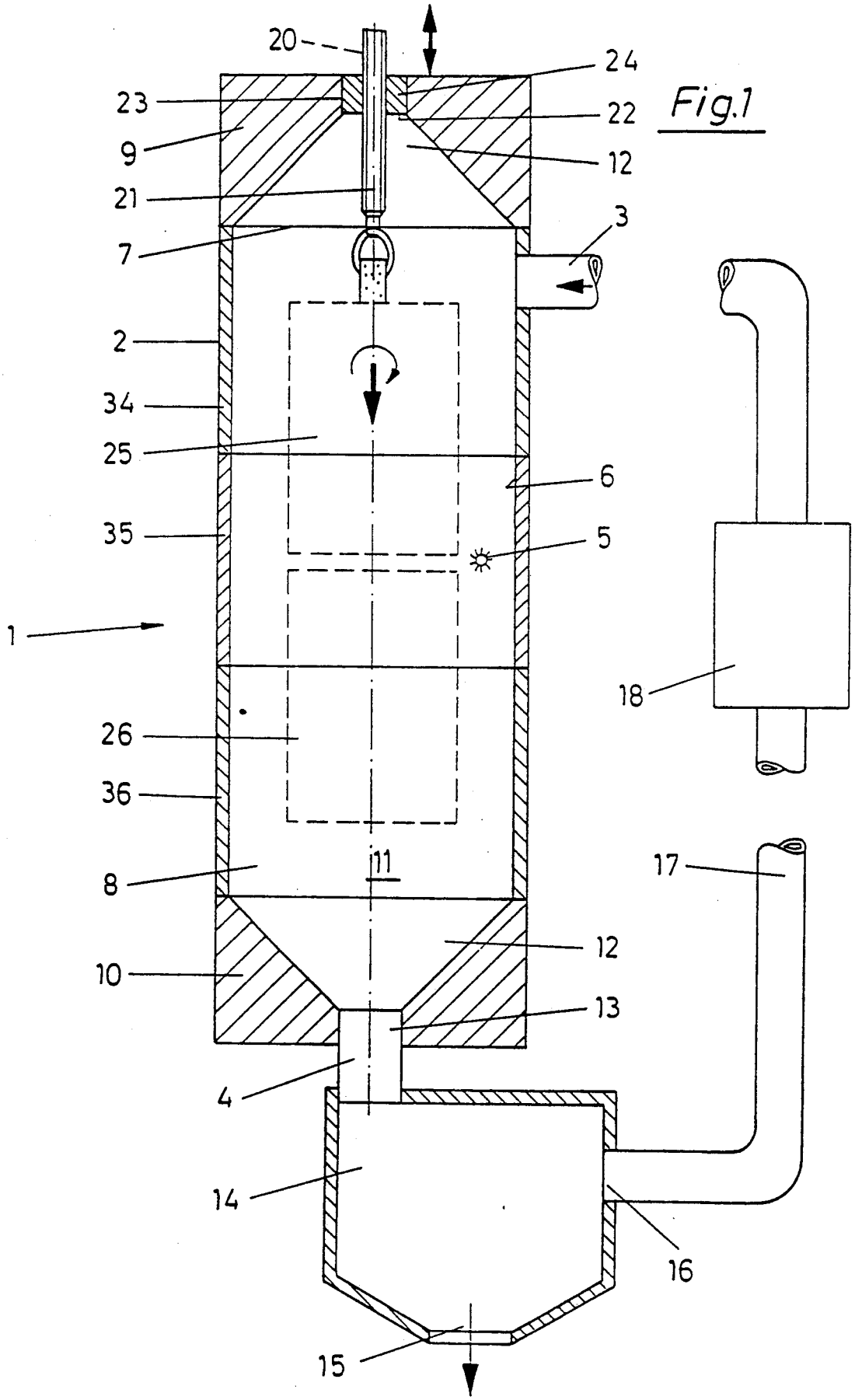
FIG. 1 a longitudinal section through the cleaning device.

The cleaning device (1) depicted in FIG. 1 is a tubular chamber (2) with the water intake (3) at the top and the water outlet (4) at the bottom. An electrode (5) is positioned approximately in the middle of the chamber (2) and at a variable distance from the chamber wall (6).

The upper aperture (7) and the lower aperture (8) are sealed by closures (9, 10), so that the chamber (2) constitutes a reflection chamber during the cleaning process.

The tubular chamber interior (11) means that the shock waves generated by the electrode (5) are reflected by the chamber wall (6) and directed towards the casting element to be cleaned. This ensures optimal utilization of the energy applied. Because of the special configuration of the recesses (12) in the closures (9, 10), reflection of the shock waves in this area as well is achieved, so that even better use is made of the shock wave energy.

The depiction in FIG. 1 shows that the total chamber (2) consists of individual sections (9, 34, 35, 36, 10), which not only facilitates building, but also makes it possible to position the electrode (5) with accuracy. It is conceivable that for larger components or longer components, another section could simply be added on, so that the total length of the chamber (2) is adapted to the respective component.

The lower closure (10) has an outlet hole (13) at the base. By way of this outlet hole (13), the separated material passes together with a corresponding amount of water continually into the container (14), where it can settle to the bottom. By way of the solid matter valve (15), these elements are then intermittently withdrawn and effectively stored away. As an alternative, the container (14) can be replaced by a reel conveyor belt. In this way, direct and continuous disposal of the solid matter is possible. Only very little water containing solid matter passes through the water outlet (16) into a pipeline (17), preferably a closed circular pipeline. This pipeline (17) contains a filter (18) in which the rest of the solid matter is separated and removed. Any additional water needed is added in the area of the water intake, for example, and this is exactly the same amount as that solid matter and water removed via the solid matter valve (15).

The upper closure (9) moves up and down with the hoist (20), so that the entire aperture (7) is available for inserting the component. In this process, the cluster (25, 26) hangs on a rod (21), that can be inserted as such through the hole positioned in the bottom (22) of the closure (9) and the ring (24) or universal joint slaving. In this way, after the detached closure (9), it is possible to move the cluster from position (25) to position (26) or vice versa, without the position of the closure (9) changing. If the ring (25) is made of flexible material or if a universal joint slaving is built in, then it is also possible, as indicated in FIG. 2, to swivel the cluster (25 or 26) in such a way that an additional effect on the individual elements of the cluster is possible by the pressure waves and the reflection waves. FIG. 2 also shows that the length of the chamber (2) clearly exceeds the length of the individual cluster (25). In this way, the cluster can be slowly and practically passed by the electrode (5) in order to affect it by different pressure waves—and especially reflection waves—from all sides.

Figure 2A:
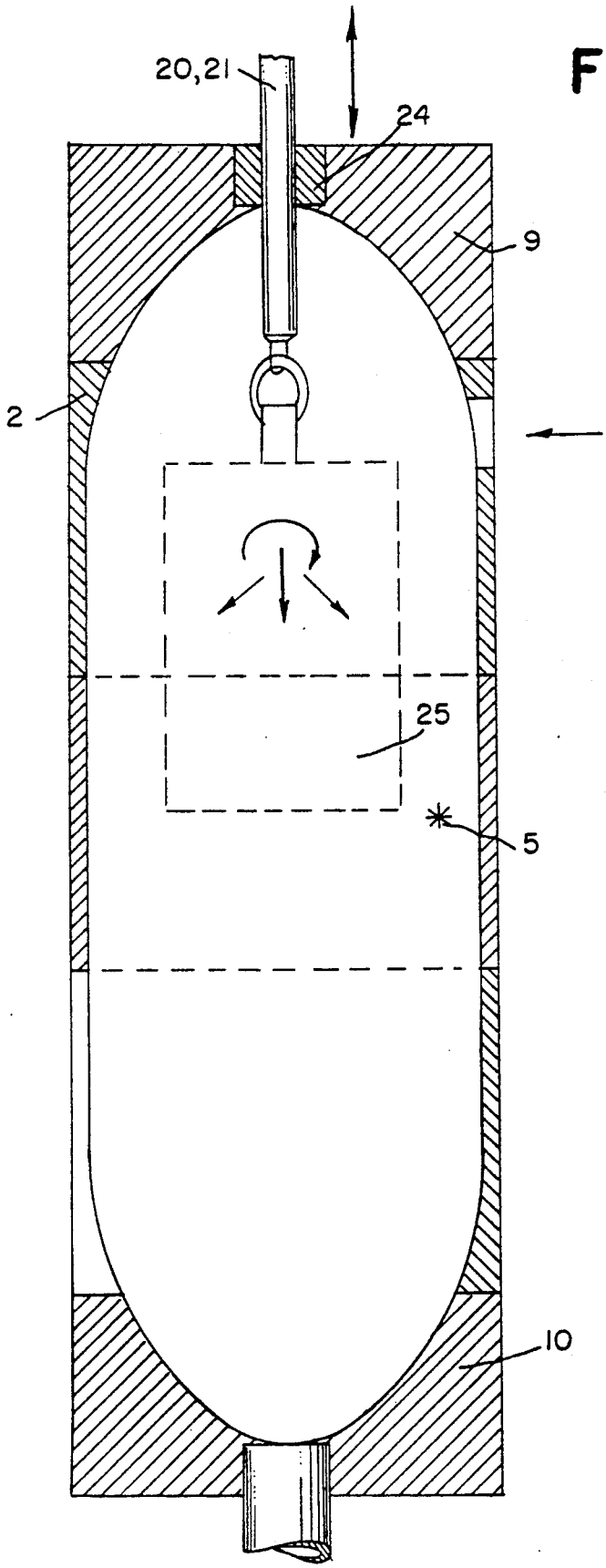
FIG. 2 an enlarged representation of the cleaning device
Figure 2:
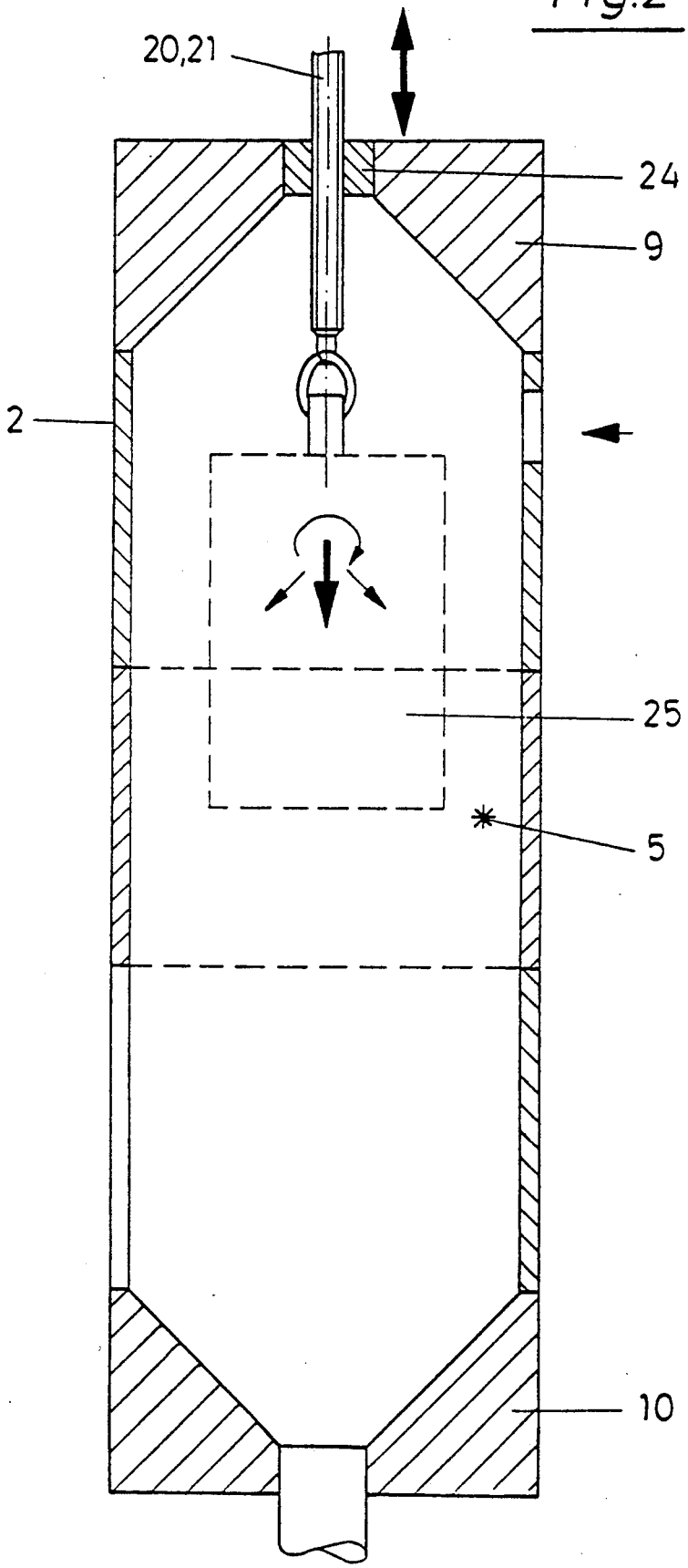

FIG. 2A shows an embodiment in which the interior of the chamber (2) is elliptical in shape, thus forming an ellipse along with the closures. Also, plural reflectors (R) are placed around the chamber in the vicinity of the electrodes to enhance reflection of the waves.

Figure 3:
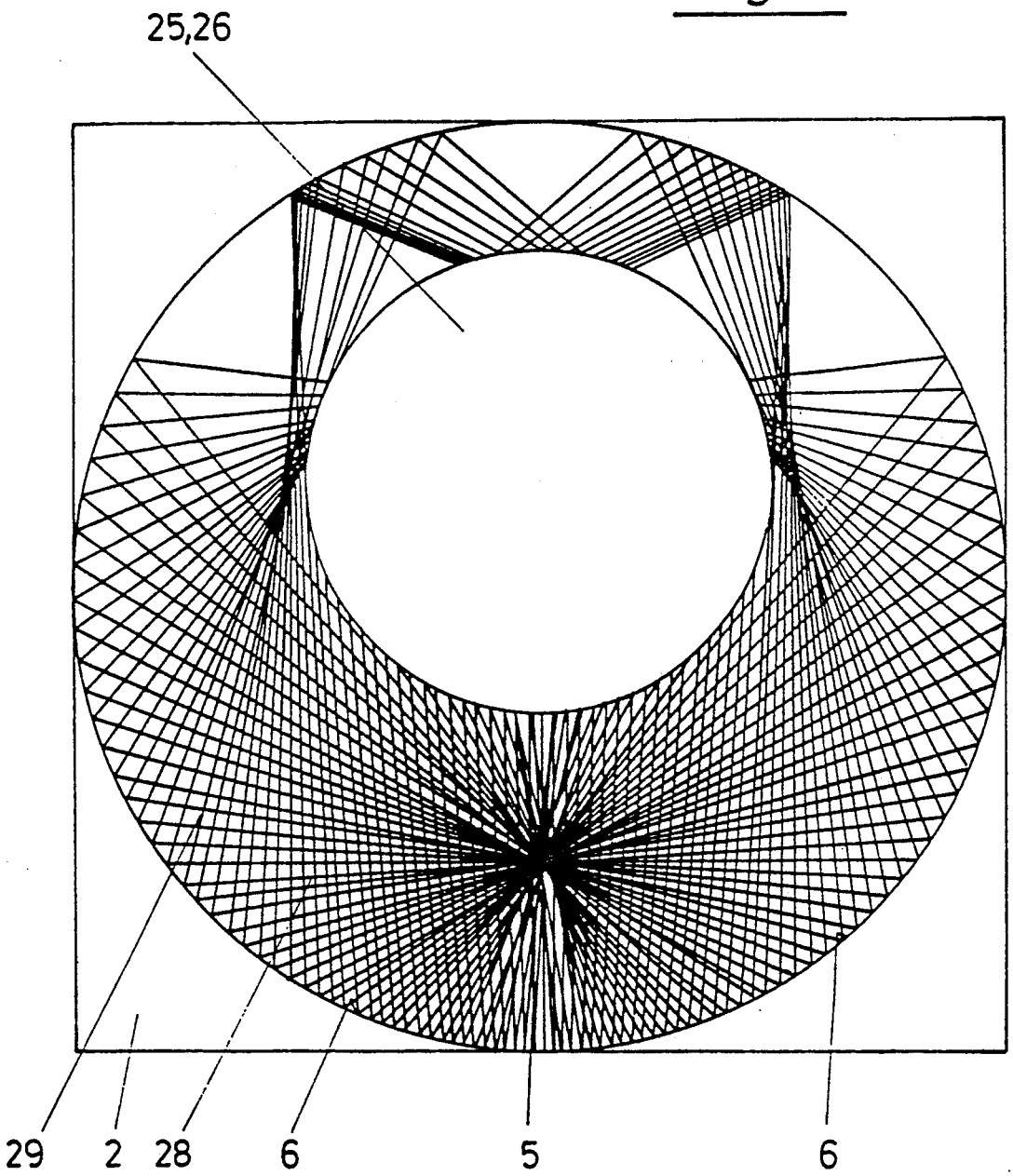
FIG. 3 a cross-section through the cleaning device with a representation of the course of the shock wave FIG. 4 a cross-section through a cleaning device with a small electrode.

FIG. 3 shows a cross-section through the chamber (2) approximately in the area of the electrode (5). A cluster (25, 26), which is circular here, is inserted into the chamber (2). Under corresponding assumptions and a simplified depiction, it is clear that the pressure waves (28) emanating from the electrode (5) are effectively reflected by the chamber wall (6) and then pass back to the cluster (25, 26) as reflection waves (29). In certain places, there is overlapping and concentrations, whereby certain spots on the cluster can be effectively influenced by this wave concentration through appropriate positioning of the cluster (25, 26) and/or the electrode (5). A rapid and intensive cleaning of clusters (25, 26) or other components is achieved in this way.

Figure 4:
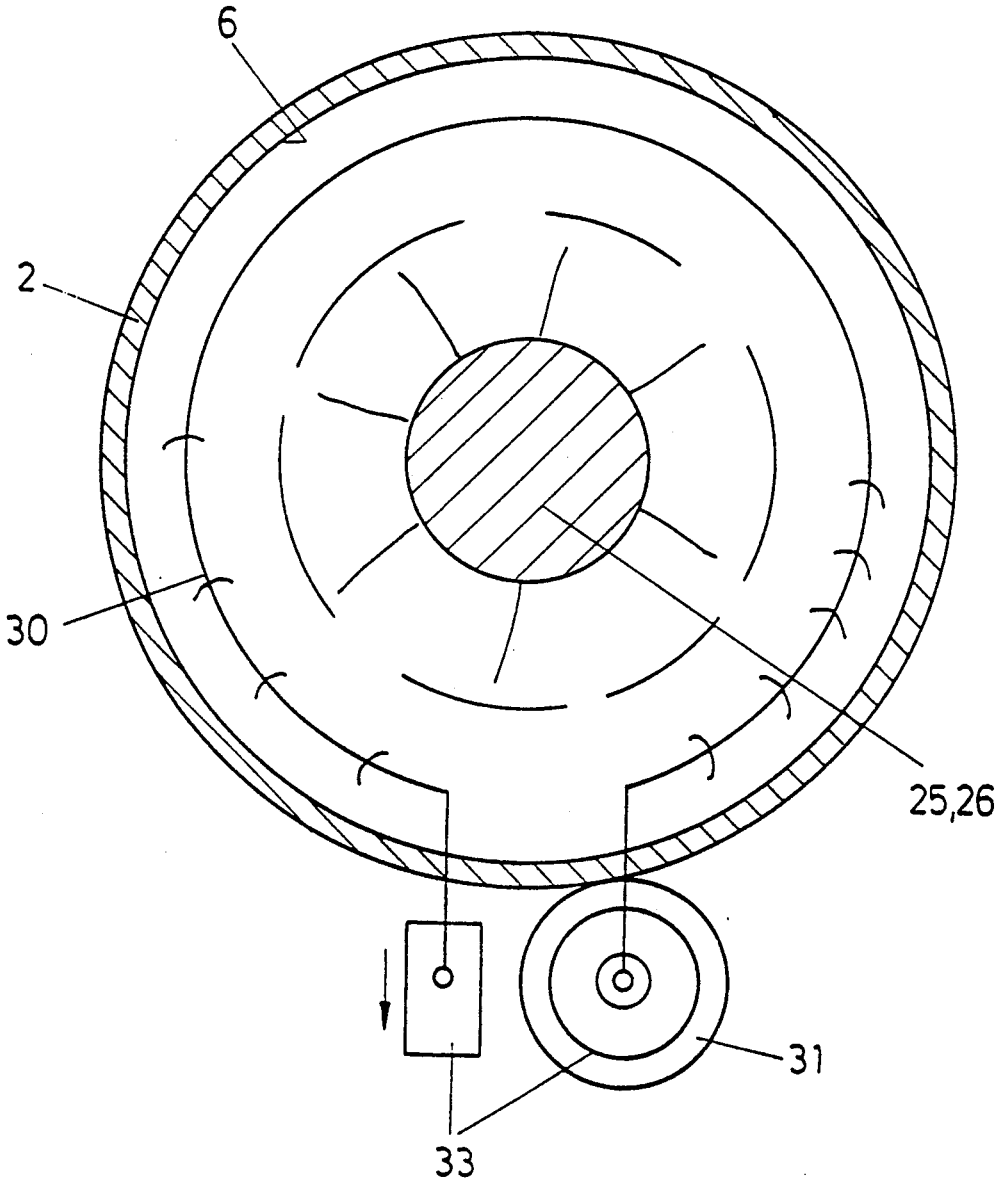

FIG. 4 shows a special configuration insofar as the electrode depicted is not the one in FIGS. 1, 2, and 3, but rather a ring-shaped electrode. This ring-shaped electrode is a copper wire (30) that is extruded from a wire magazine (31), by the feeding mechanism (33) also positioned at the other end. In this way, a new wire is pushed on more quickly and also effectively taken up by the corresponding part of the feeding mechanism (33) in such a way that a precise generation of the next shock wave is again possible. Because of the wire, which vaporizes in generating the pressure wave, a linear pressure discharge is achieved, whereby effective pressure waves are created that make it possible to safely clean even parts of casting elements that are hard to reach.

While the invention has been described with reference to specific embodiments, modifications and variations of the invention may be constructed without departing from the scope of the invention, which is described in the following claims.

We claim:

1. Cleaning device for castings and similar components with coatings, especially for precision casting elements covered with a thin ceramic layer, comprising a chamber filled with water and an electrode positioned in the water, as well as a hoist that supports and moves the components in the chamber between a first end and a second end of the chamber, wherein the chamber (2) has a tubular configuration and upper and lower closable apertures (7, 8) at the first and second ends of the chamber respectively and the electrode (5) is positioned approximately in a longitudinal middle of the chamber between the upper and lower apertures and when viewed from a horizontal cross-section is positioned in the vicinity of the chamber wall.

2. Cleaning device as claimed in claim 1, wherein the chamber (2) is positioned endwise and has detachably configured upper and lower closures (9, 10) on either side, to close the upper and lower apertures (7, 8) respectively.

3. Cleaning device as claimed in claim 2,
wherein the closures (9, 10) have an open recess (12) that acts as a reflector and faces the interior of the chamber (11).

4. Cleaning device as claimed in claim 3,
wherein the recess (12) has an elliptical shape.

5. Cleaning device as claimed in claim 3,
wherein the upper closure (9) has a hole (23) in a bottom (22) of the recess (12) that holds a rod (21) of the hoist (20) and is equipped with a ring consisting of flexible material (24).

6. Cleaning device as claimed in claim 5,
wherein the hoist (20) is configured to lower and raise as well as to rotate and swivel the rod (21).

7. Cleaning device as claimed in claim 2, wherein the lower closure (10) has an outlet hole (13) to which a container (14) is allocated, said container being equipped with a solid matter valve (15) positioned at a base of the container and with a water outlet (16).

8. Cleaning device as claimed in claim 1,
wherein the interior (11) of the chamber (2) is shaped so as to form an ellipse.

9. Cleaning device as claimed in claim 1,
wherein the chamber (2) is larger or longer, at least twice as long, as the components to be cleaned (25, 26).

10. Cleaning device as claimed in claim 1, wherein the electrode (5) is movably positioned in the chamber (2).

11. Cleaning device as claimed in claim 1, wherein the electrode (5) consists of a coaxial conductor.

12. Cleaning device as claimed in claim 1, wherein there are plural reflectors, preferably dish or ring reflectors, positioned in the chamber (2) around the electrodes (15).

13. Cleaning device as claimed in claim 1, wherein a rod (21) is positioned in the closure (9).

* * * * *